United States Patent [19]

Pomeranz

[11] Patent Number: 4,479,307

[45] Date of Patent: Oct. 30, 1984

[54] GUN SIGHT FOR HAND AND SHOULDER GUNS

[76] Inventor: Robert B. Pomeranz, 651 Campfire Rd. SE., Rio Rancho, N. Mex. 87124

[21] Appl. No.: 547,636

[22] Filed: Nov. 1, 1983

Related U.S. Application Data

[63] Continuation-in-part of Ser. No. 370,286, Jun. 4, 1982, abandoned.

[51] Int. Cl.[3] ..... F41G 1/10

[52] U.S. Cl. ..... 33/233; 33/251; 42/1 S

[58] Field of Search ..... 33/233, 251, 252, 241, 33/242, 243, 265, 257, 258; 42/1 S

[56] References Cited

U.S. PATENT DOCUMENTS

| | | | |
|---|---|---|---|
| 1,275,147 | 8/1918 | Frensdorf | 33/233 |
| 2,610,406 | 9/1952 | Chambers | 33/251 |
| 3,698,091 | 10/1972 | Merrill et al. | 33/233 |

FOREIGN PATENT DOCUMENTS

| | | | |
|---|---|---|---|
| 453656 | 12/1927 | Fed. Rep. of Germany | 33/233 |
| 1366378 | 6/1964 | France | 33/251 |
| 24536 | of 1895 | United Kingdom | 33/233 |
| 28973 | of 1913 | United Kingdom | 33/233 |

*Primary Examiner*—William D. Martin, Jr.
*Attorney, Agent, or Firm*—Harvey B. Jacobson

[57] ABSTRACT

A sight assembly is provided including front and rear sights for mounting on the front and rear ends of a gun barrel. The front sight comprises a conventional upstanding vertically elongated blade sight member having vertical planar outwardly facing opposite side faces joined at their upper ends by a transverse horizontal top surface and the rear sight includes a pair of laterally spaced apart opposite side plates disposed transverse to and on opposite sides of the sight path extending between the front and rear sights and including opposing inner upstanding opposing transverse end edges having relatively angulated upper and lower portions as well as longitudinal top surfaces extending oppositely outwardly from the end edges. The upper portions of the end edges are vertically disposed and spaced apart a predetermined distance substantially equal to the thickness of the front blade sight member. The included angle between each of the end edge upper portions and the corresponding plate top surface is readily visually ascertainable at less than 90° and more than 45°. The lower portions of the end edges are downwardly divergent and define an included angle of less than 90° and more than 45°.

10 Claims, 7 Drawing Figures

GUN SIGHT FOR HAND AND SHOULDER GUNS

REFERENCE TO RELATED APPLICATION

This application comprises a continuation-in-part of my co-pending application U.S. Ser. No. 370,286, for A NEW GUNSIGHT FOR HAND AND SHOULDER GUNS: REAR SIGHT, filed June 4, 1982, now abandoned.

BACKGROUND OF THE INVENTION

Various different forms of "open" front and rear sights have been used on hand guns and shoulder guns. A typical form of "open" front sight incorporates an upstanding blade member having vertical planar oppositely outwardly facing side faces or surfaces joined at their upper ends by a transverse horizontal top surface and a typical rear sight used in conjunction with such a front blade sight member includes a transfer body having a horizontal transverse upper surface and an upwardly opening notch formed therein opening upwardly centrally through the upper surface. A first form of typical rear sight includes a notch having vertical opposite side edges and a second form of typical rear sight includes a notch having upwardly divergent side surfaces. A line of sight is defined between the front and rear sights when the blade member is centered in the notch of the rear sight and the upper edge of the blade sight member is horizontally coextensive with the upper edge of the rear sight.

However, these previously known forms of conventional front and rear sight requires a person performing a sighting operation to ascertain and maintain equal spacing between the opposite sides of the blade sight member and the corresponding opposing sides of the notch. This must be accomplished while maintaining proper horizontal alignment between the upper surfaces of the front and rear sight and both lateral and vertical alignment of the target with the upper surface of the front sight. Accordingly, although an expert marksman may accomplish these alignment tasks almost automatically, even an experienced marksman has difficulty in accomplishing the various above alignment functions as well as the centering function of maintaining the forward blade sight centered in the notch of the rear sight.

In addition, the desired spacing between the sides of the notch of a conventional rear sight and the corresponding sides of an associated front blade sight member, in a sight picture, may vary according to the length of the arm of the user of an associated hand gun and the firing stance of the user of a long gun. Accordingly, a need exists for a notch defining rear sight to be adjustable to the extent that the width of the notch defined thereby may be varied.

Various different forms of sights including some of the general structural and operational features of the instant invention are disclosed in U.S. Pat. Nos. 821,821, 1,307,647, 2,335,881, 3,112,566, and 3,451,137 as well as German Pat. No. 665,662 and Great Britain Pat. No. 619,588.

BRIEF DESCRIPTION OF THE INVENTION

The sight assembly of the instant invention incorporates a conventional forward upstanding blade sight member and a rear sight assembly defining an upwardly opening notch in which the front blade sight member is to be centered in the user's sight picture. In addition, the rear sight member is constructed in a manner whereby the width of the upwardly opening notch defined thereby may be adjusted so that the width of the notch, in the user's sight picture, is exactly the same as the width of the front sight blade member. Also, the sight assembly is further constructed to provide ample area in the user's sight picture to locate the target.

The main object of this invention is to provide an improved sight assembly of the open sight type for use on hand guns as well as long guns.

Still another object of this invention is to provide an improved open sight assembly constructed in a manner whereby the user may readily ascertain when the forward sight member is centered in the upwardly opening notch defined by the rear sight.

Another important object of this invention is to provide a sight assembly constructed in a manner whereby the width of the upwardly opening notch in the rear sight may be adjusted to suit a particular user's firing stance.

A further object of this invention is to provide an improved open sight assembly which incorporates major sighting surfaces which are to be maintained in the same operative relationship when forming a sight picture and further including minor sighting surfaces which may be varied according to the preference of a particular user of the sight.

A final object of this invention to be specifically enumerated herein is to provide a sight assembly in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
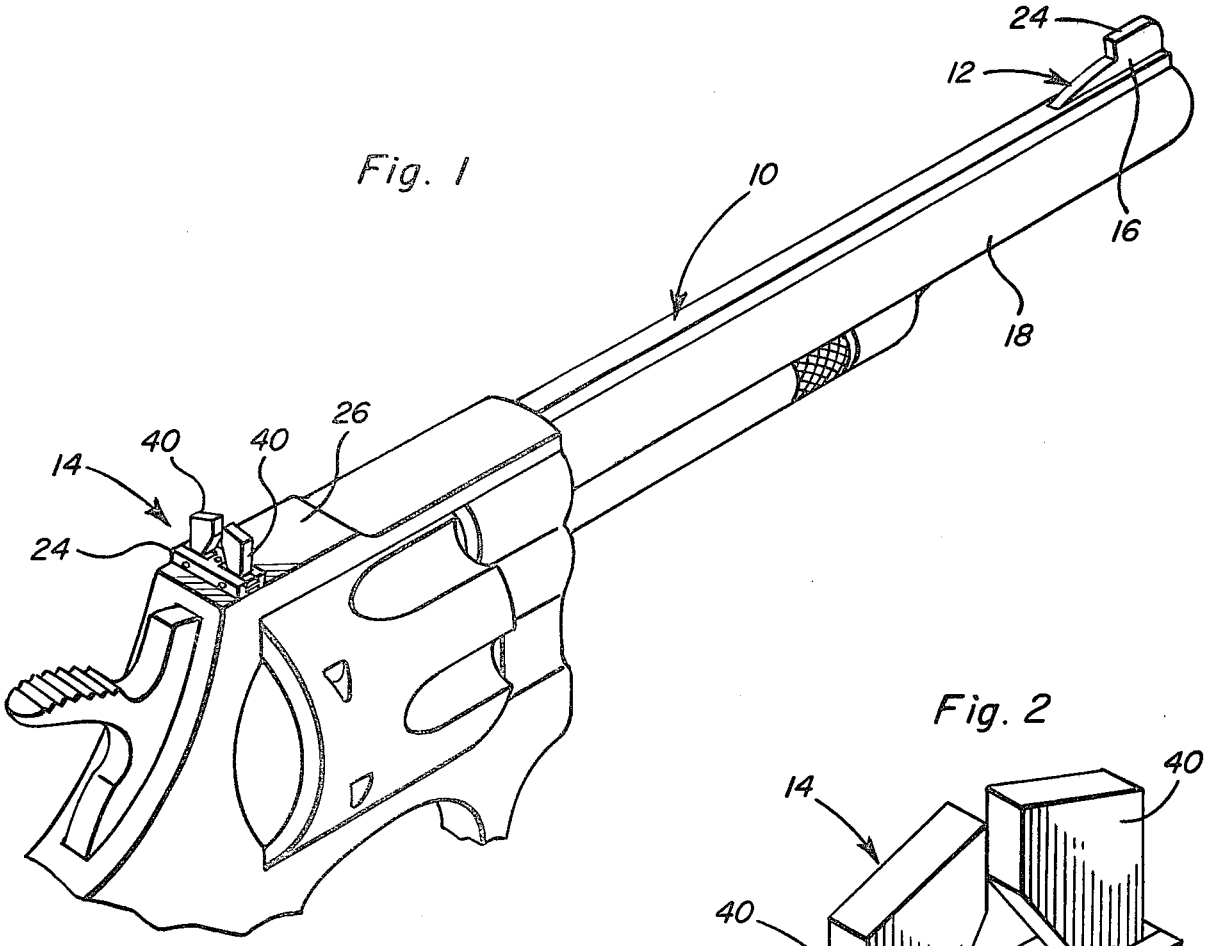
FIG. 1 is a fragmentary perspective view of a typical form of hand gun incorporating the improved sight construction of the instant invention.

Referring now more specifically to FIG. 1 of the drawings, the numeral 10 generally designates a conventional form of hand gun incorporating the sight assembly of the instant invention including a forward sight referred to in general by the reference numeral 12 and a rear sight referred to in general by the reference numeral 14. The forward or sight 12 comprises an upstanding blade-type sight member 16 which may be semi-permanently secured to the forward end of the barrel 18 of the hand gun 10. The sight member 16 includes vertical oppositely outwardly facing side surfaces 20 and 22 whose upper extremities are interconnected by a horizontal top surface 24. Accordingly, the sight member 16 may be considered as conventional in design.

The rear sight 14, on the other hand, includes a base plate 24 which is elongated transversely of the rear of the frame 26 of the hand gun 10 and the underside of the base plate 24 includes a dovetailed slot 30 milled therein in which a mating dovetailed projection 32 mounted on the rear of the frame 26 is snugly slidingly received. The center portion of the base plate 24 includes a threadedly mounted set screw 34 which projects down into the groove 30 and may be used to maintain the base plate 24 in longitudinally adjusted position laterally of the frame 26.

The opposite end portions of the upper surface of the base plate 24 include dovetailed grooves 36 formed therein and dovetailed base portions 38 of a pair of horizontally elongated and laterally spaced apart transverse plates 40 are snugly and slidingly received, the forward side of the base plate 24 including a pair of corresponding set screws 42 threadedly supported therefrom and engageable with the base portions 38 of the plates 40 for releasably retaining the latter in adjusted positions longitudinally of the base plate 24.

Figure 2:
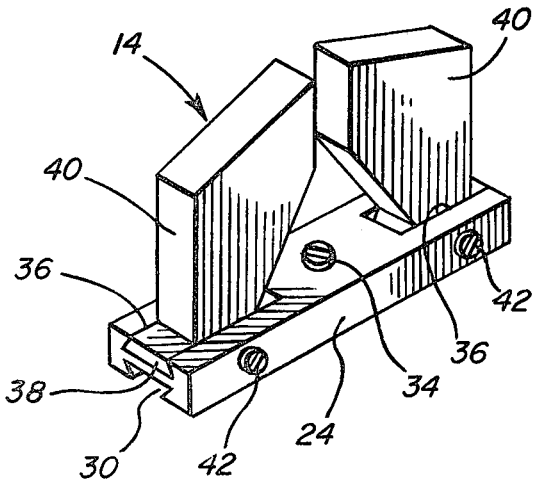
FIG. 2 is an exploded perspective view of the rear sight assembly.
Figure 3:
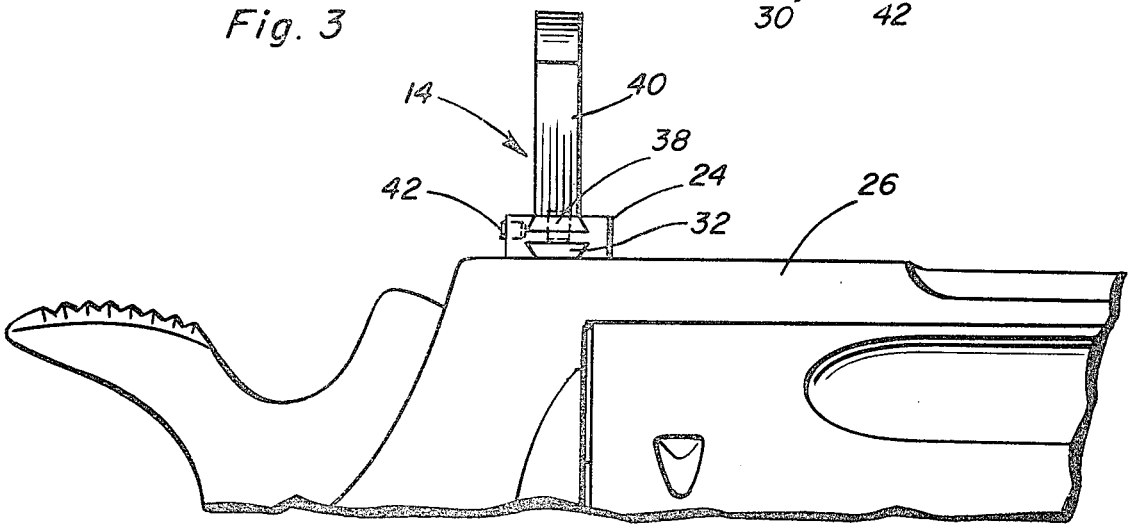
FIG. 3 is an enlarged fragmentary side elevational view of the rear portion of the hand gun illustrated in FIG. 1 and the rear sight assembly supported therefrom.
Figure 5:
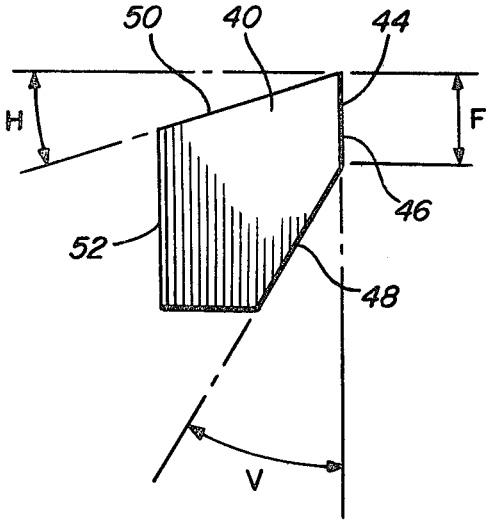
FIG. 5 is a rear elevational view of one of the side plates of the rear sight and illustrating those dimensions of the sight plate which may be varied according to the preference of a given user of the sight.

With attention now invited more specifically to FIGS. 2 and 5 of the drawings, it may be seen that each of the plates 40 includes an inner end 44 having relatively angulated upper and lower transverse end surfaces 46 and 48. In addition, each plate 40 includes a top surface 50 and an outer end surface or face 52. The surfaces 46 are vertically disposed and thus parallel while the surfaces 48 are downwardly divergent. Further, the surfaces 50 are downwardly and outwardly inclined and the surfaces 52 are vertical and thus parallel with the surfaces 46.

The height of the surfaces 46 is less than one-half of the height of the plates 40 and the included angle between each pair of surfaces 46 and 50 may be readily visually ascertained as less than 90° and more than 45°. In addition, the included angle defined between each pair of opposing surfaces 48 may be readily visually ascertained as less than 90° and more than 45°.

Figure 4:
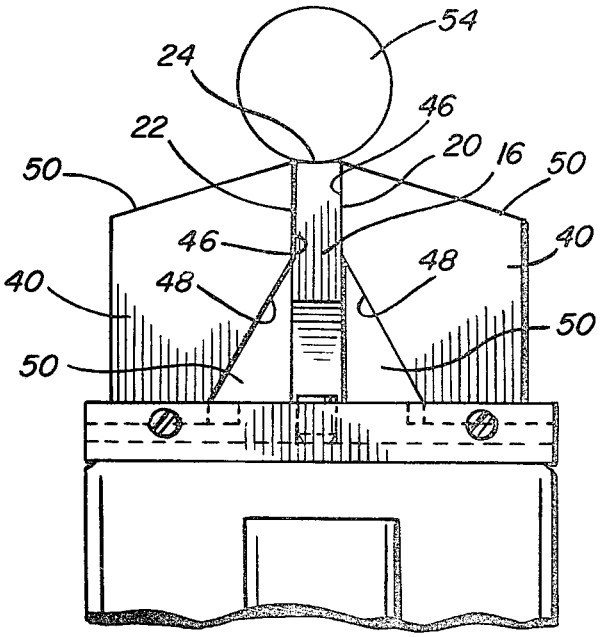
FIG. 4 is an enlarged rear elevational view of the upper portion of the hand gun illustrated in FIG. 1 and illustrating the desired sight picture.

With attention now invited more specifically to FIG. 4, the target in the sight picture illustrated in FIG. 4 is indicated by the reference numeral 54 as seated on the upper surface 24 of the sight member 16 and substantially centered relative thereto. In addition, the distance between the side faces 20 and 22 of the sight member 16 is such that the sight member 16 precisely fills the space defined between the surfaces 46 of the plates 40. Accordingly, if any space may be seen between one of the surfaces 46 and the opposing side of the sight member 16, the user of the gun 10 immediately knows that the sight member 16 is not centered in the upwardly opening notch defined between the plates 40. In addition, the downwardly divergent surfaces 48 provide ample spaces 50 on opposite sides of the lower portion of the sight member 16 and the lower surfaces 48 to facilitate the user of the gun 10 locating the target 54 if the latter is disposed below the upper surface 24 of the sight member 16. Further, the downwardly and outwardly inclined surfaces 50 of the plates 40 provide additional spacing or voids outward of the opposite longitudinal edges of the upper surface 24 of the sight member 16 in order to locate the target 54.

If the arms of the user of the hand gun 10 are relatively short, it will be necessary to space the plates 40 closer together in order to eliminate any spacing between opposite sides of the sight member 16 and the opposing surfaces 46 of the plates 40 in the sight picture illustrated in FIG. 4. Conversely, if the user's arms are relatively long, it may be necessary to shift the plates 40 further apart. In any event, when the spacing between the plates 40 has been accurately adjusted for a particular user of the gun 10, the entire set of plates 40 may be shifted laterally of the frame 26 in order to make any desired lateral sight adjustment.

Figure 6:
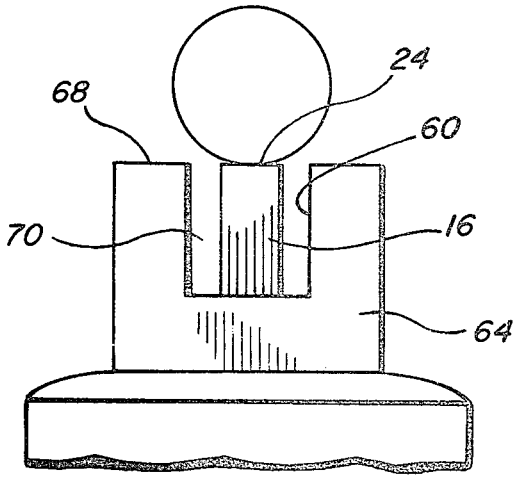
FIGS. 6 and 7 are fragmentary enlarged rear elevational views similar to FIG. 4 and illustrating conventional forms of open sights and the sight pictures obtained through the use thereof.
Figure 7:
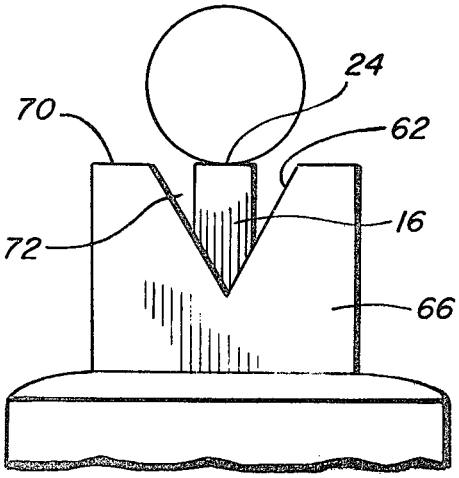

From a comparison of FIG. 4 with FIGS. 6 and 7, it will be noted that the centering of the sight member 16 in the spacing between the surfaces 46 of FIG. 4 may be far more accurately determined than the centering of the sight member 16 in the conventional notches 60 and 62 of the rear sights 64 and 66 illustrated in FIGS. 6 and 7. In addition, the elevation of the upper surfaces 24 of the sight member 16 illustrated in FIG. 4 in relation to the upper innermost extremities of the surfaces 50 may be more precisely obtained than a coplanar relationship between the upper surfaces 24 in FIGS. 6 and 7 with the upper surfaces 68 and 70 of the rear sights 64 and 66. Still further, the spaces 50 provide target locating spaces which are greater in area than the target locating spaces 70 and 72 defined by the sight pictures in FIGS. 6 and 7.

As indicated in FIG. 5 of the drawings, the distance F may be varied according to the preference of the intended user of the hand gun 10. In addition, the angles H and V may also be varied according to the preference of the intended user.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination with a gun including an elongated barrel having opposite front and rear ends, a sight assembly including front and rear sights, said front sight being mounted on a forward portion of said gun barrel and said rear sight being mounted from said gun rearward of said front sight and in substantial front-to-rear alignment with said front sight, said front and rear sights defining a sight path extending therebetween, said front sight comprising a upstanding vertically elongated blade sight member having vertical parallel planar outwardly facing opposite side faces joined at their upper ends by a transverse horizontal top surface, said rear sight including a pair of laterally spaced apart opposite side plates disposed transverse to and on opposite sides of said sight path and including inner upstanding opposing transverse end edges having relatively angulated upper and lower portions and top surfaces extending oppositely outward from said end edges, said upper portions of said end edges being vertical and spaced apart a predetermined distance, the included angle between each of said end edge upper portions and the corresponding plate top surface being readily visually ascertainable as less than 90° and more than 45°, said lower portions of said end edges being downwardly divergent and defining an included angle of less than 90° and more than 45°.

2. The sight assembly of claim 1 wherein said included angle between said lower portions of said end edges is substantially 60°.

3. The sight assembly of claim 1 wherein the spacing between the upper portions of said end edges is substantially the same as the transverse thickness of said blade sight member as said front and rear sights are viewed along said sight path from rearward of said rear sight.

4. The sight assembly of claim 1 wherein the vertical height of said upper portions of said inner end edges is less than one-half the combined vertical height of said upper and lower portions of said inner end edges.

5. The sight assembly of claim 4 wherein said combined vertical height substantially equals the height of said blade sight member.

6. The sight assembly of claim 1 wherein said transverse plates include remote outer end edges, said outer end edges being substantially vertical.

7. The sight assembly of claim 6 wherein said included angle between said lower portions of said end edges is substantially 60°.

8. The sight assembly of claim 7 wherein the spacing between the upper portions of said end edges is substantially the same as the transverse thickness of said blade sight member as said front and rear sights are viewed along said sight path from rearward of said rear sight.

9. The sight assembly of claim 8 wherein the vertical height of said upper portions of said inner end edges is less than one-half the combined vertical height of said upper and lower portions of said inner end edges.

10. In combination with a gun including an elongated barrel having opposite front and rear ends, a sight assembly including front and rear sights, said front sight being mounted on a forward portion of said gun barrel and said rear sight being mounted from said gun rearward of said front sight and in substantial front-to-rear alignment with said front sight, said front and rear sights defining a sight path extending therebetween, said front sight comprising a upstanding vertically elongated blade sight member having vertical parallel planar outwardly facing opposite side faces joined at their upper ends by a transverse horizontal top surface, said rear sight including a pair of laterally spaced apart opposite side plates disposed transverse to and on opposite sides of said sight path and including inner upstanding opposing transverse end edges having relatively angulated upper and lower portions and top surfaces extending oppositely outward from said end edges, said upper portions of said end edges being vertical and spaced apart a predetermined distance, the included angle between each of said end edge upper portions and the corresponding plate top surface being readily visually ascertainable as less than 90°, the spacing between the upper portions of said end edges being substantially the same as the transverse thickness of said blade sight member as said front and rear sights are viewed along said sight path from rearward of said rear sight.

* * * * *